United States Patent [19]

Fuss

[11] Patent Number: 4,672,695

[45] Date of Patent: Jun. 16, 1987

[54] UPHOLSTERED FURNITURE

[76] Inventor: Rainer Fuss, Hoelderlinstrasse 7, D-7000 Stuttgart 1, Fed. Rep. of Germany

[21] Appl. No.: 796,556

[22] Filed: Nov. 8, 1985

[30] Foreign Application Priority Data

Nov. 8, 1984 [DE] Fed. Rep. of Germany ..... 3440793

[51] Int. Cl.[4] ..... A47D 11/00; A47C 17/00

[52] U.S. Cl. ..... 5/2 R; 5/12 R; 5/431; 5/465; 16/322; 16/334

[58] Field of Search ..... 5/2 R, 12 R, 17, 28, 5/37.2, 41, 42, 431, 465; 16/321, 322, 324, 326, 328–332, 334

[56] References Cited

U.S. PATENT DOCUMENTS

| | | | |
|---|---|---|---|
| 3,706,473 | 12/1972 | Mullen | 5/465 |
| 4,148,521 | 4/1979 | Van Hook | 5/465 |
| 4,186,905 | 2/1980 | Brudy | 16/321 |
| 4,216,844 | 8/1980 | Klafs | 16/329 |
| 4,403,373 | 9/1983 | Kummerlin | 16/328 |
| 4,566,150 | 1/1986 | Boothe | 16/332 |

FOREIGN PATENT DOCUMENTS

| | | |
|---|---|---|
| A0123078 | 7/1984 | European Pat. Off. . |
| 2130873 | 1/1973 | Fed. Rep. of Germany . |
| 2087577 | 12/1971 | France . |
| 2196134 | 3/1974 | France . |
| 2392268 | 12/1978 | France . |

*Primary Examiner*—Smith: Gary L.
*Assistant Examiner*—Michael F. Trettel
*Attorney, Agent, or Firm*—Thomas W. Speckman

[57] ABSTRACT

The invention concerns upholstered furniture with a number of cylindrical padding elements, mounted on bearing shafts, with the ends of said bearing shafts on both sides of the padding elements being positioned immediately adjacent to one another in a manner similar to an open bicycle chain; the connecting ends of said connecting straps each being provided with a circle of holes, pivoting on the bearing shafts, and using a positioning element equipped with pins, being adjustable in set angular positions with respect to one another, said pins being able to engage in aligned holes of the connecting ends of the connecting straps, said ends being mounted on a bearing shaft, and, to adjust the angular position of the connecting straps, said pins being also retractable. A simple fitting which can be preassembled is produced, said fitting facilitating assembly of the upholstered furniture and improving the ease of use when changing the upholstered furniture.

10 Claims, 9 Drawing Figures

UPHOLSTERED FURNITURE

The invention concerns upholstered furniture with a number of cylindrical padding elements, mounted on bearing shafts, with the ends of said bearing shafts on both sides of the padding elements being positioned immediately adjacent to one another in a manner similar to an open bicycle chain; the connecting ends of said connecting straps each being provided with a circle of holes, pivoting on the bearing shafts, and being adjustable at set angles with respect to one another by means of a positioning element equipped with pins, said pins being able to engage in aligned holes of the connecting ends of the connecting straps, said ends being mounted on a bearing shaft, and, to adjust the angular position of the connecting straps, said pins being also retractable.

Upholstered furniture of this type is prior art by virtue of the European Patent Application No. 0 123 978. In this upholstered furniture of prior art, the positioning element is braced against the connecting ends of the connecting straps by means of a stop plate. In this method, the stop plate has a threaded piece which is screwed into a nut, said nut being fixed in position in the open end of the bearing shaft designed as a section of pipe. As, in order to change the position of the padding elements, a number of positioning elements must be manipulated, this screw connection cannot be considered easy to use. In addition, it is not ensured that this screw connection can be tightened sufficiently so that it does not loosen by itself unintentionally.

It is the purpose of this invention to produce upholstered furniture of the type mentioned at the beginning with which precisely the assembly of the upholstered furniture is simplified and the ease of use when changing the upholstered furniture improved.

This purpose is achieved by the invention in that the connecting ends of the connecting straps are each pivoted on a bearing bush which is connected to the corresponding end of the bearing shaft by means of a threaded connection, in that the free end of the bearing bush is equipped with a stop collar, in that a compression spring which presses the connecting ends of the corresponding straps against a retainer at the end of the bearing shaft by means of a hollow, cylindrical supporting block is pressed over the bearing bush following the base plate, in that the bearing shaft, the base plate, the compression spring and the supporting block are surrounded by the compartment of the cap-shaped positioning element, the base of the cap of said positioning element being equipped with an opening to provide access to the tool seat of the bearing bush, in that an additional compression spring is braced against the base plate, the other end of said compression spring being held in the area of the open side of the compartment by means of a supporting plate, and in that the base plate is provided with shoulders around the circumference, dogs formed on the compartment protruding between these shoulders, said dogs extending, starting from the base of the cap, only a portion of the depth of the compartment in the positioning element.

In this design, the positioning element with the parts enclosed in the compartment form a single unit which is prefabricated and need only be connected to the bearing shaft by way of the bearing bush. In this manner, assembly of the upholstered furniture is simplified considerably as the unit can easily be mounted on the padding elements equipped with the bearing shaft by using the corresponding connecting ends of the connecting straps. By raising the positioning element against the spring force of the additional compression spring, the pins can be retracted from the holes in the connecting ends of the connecting straps. If the positioning element is rotated slightly, the dogs of the compartment of the positioning element can be braced on the shoulders of the base plate. In this manner, the positioning element remains in the unlatched position and the connecting straps can be rotated on the bearing bush as desired. Raising the positioning element again and rotating it back brings the dogs of the compartment of the positioning element again between the shoulders of the base plate so that the additional compression spring can again insert the pins into the aligned holes of the connecting ends of the connecting straps. The compression spring braced on the supporting block presses the connecting ends of the connecting straps against the retainer at the end of the bearing shaft so that this connection has virtually no play, a feature which has a beneficial effect on the stability and torsional rigidity of the upholstered furniture.

In one design, it has been shown to be practical for the holes in the connecting ends of the connecting straps to be uniformly spaced at specific angles of 15° and for the pins to be located on the positioning element spaced at angles which are an integer multiple of the angle of 15°, say, 60°.

The ability to make adjustments with these small angular spacings makes it possible to set the padding elements for the most varied of applications. In addition, the angular position is locked at a number of locations of the connecting ends of the connecting straps.

One design contributes to increasing the stability, said design being characterized by the connecting straps being curved in a semicircle outside the connecting ends.

The mounting of the retainer on the end of the bearing shaft is solved in one design such that the bearing shaft is designed as a section of pipe, one disk-shaped retainer is inserted in each open end of the section of pipe, said retainer being held with a sleeve-shaped shoulder, said shoulder being provided with a compartment for the bearing bush, and a threaded rod being held in the shoulder so that the rod cannot rotate and so that it is centered with respect to the section of pipe, said bearing bush with an internal screw thread being screwed onto said rod. In addition to the aforementioned, the retainer is also provided an annular slot on the side facing the front end of the section of pipe, the end of the section of pipe being inserted into said annular slot.

The compression spring pushed onto the bearing bush following the base plate is designed as a Belleville or disk spring which can produce a sufficiently large spring force while requiring only a small amount of space.

So that the positioning element can be easily brought into the unlatched position braced on the base plate, an additional design provides that the ends of the dogs facing the connecting ends of the connecting straps are beveled as they progress into the compartment of the positioning element.

In order to be able to reach and reliably maintain the unlatched position by means of a small angle of rotation at the positioning element, one design provides that the dogs have a semicircular cross-section which roughly corresponds to one-half the cross-section of the holes in the connecting ends of the connecting straps and of the pins embedded in the positioning element, and that the shoulders on the base plate are designed in the shape of plates and extend over a number of the angle spaces between the holes in the connecting ends of the connecting straps.

The pins are fixed in the positioning element according to a preferred design such that the pins which are provided with flat surfaces or the like are injected into a positioning element designed as an injection-molded piece.

The invention provides that the additional compression spring, the spring surrounding the compression spring designed as a Belleville or disk spring and the supporting block, is designed as a coil spring, and that the supporting plate, after the bearing bush, the base plate, the two compression springs and the supporting block are inserted into the compartment of the positioning element, is connected to the positioning element and these parts are captivated in the compartment of the positioning element, facilitating the assembly of this prefabricated unit.

The invention is described in more detail using the drawings.

Figure 1:
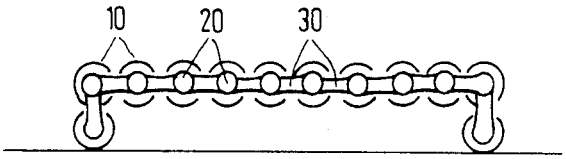
FIG. 1 shows upholstered furniture with twelve cylindrical padding elements, one after another in a row, positioned as a chaise lounge with a flat surface.

The side view of FIG. 1 shows twelve cylindrical padding elements 10 which are positioned immediately adjacent to one another forming an upholstered chain. The connecting straps 30 maintain the spacing between the padding elements 10. The padding elements 10 are centered on the bearing shafts which are connected at both ends with adjustable fittings as will be shown later. Using these fittings, the padding elements 10 can be set and locked in the most varied positions with respect to one another by rotating the connecting straps 30.

If the first and last padding elements 10 are positioned as feet by way of their vertically set connecting straps 30 at an angle with respect to the other padding elements 10 aligned horizontally by means of the horizontally positioned connecting straps 30, the upholstered furniture forms the chaise lounge shown in FIG. 1.

Figure 2:
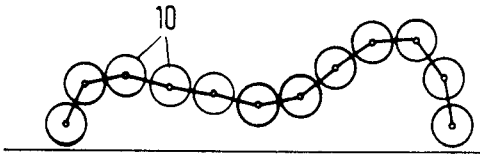
FIG. 2 depicts the upholstered furniture of FIG. 1 in a different position as a chaise lounge with an anatomically designed surface.

As indicated in FIG. 2, the padding elements located between the first and last padding elements 10 of the chain can be positioned so that the chaise lounge has an anatomically designed surface with a trough for the body and an elevated head piece.

Figure 3:
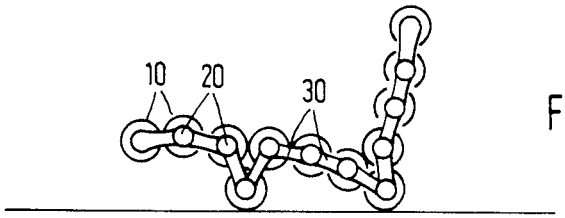
FIG. 3 shows the upholstered furniture of FIG. 1 positioned as an easy chair with a raised footrest.
Figure 4:
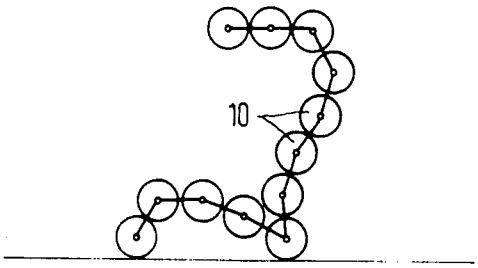
FIG. 4 illustrates the upholstered furniture of FIG. 1 positioned as an easy chair such as those used in roofed beach chairs.

FIGS. 3 and 4 show schematically the positioning of the chain of padding elements 10 as an easy chair with the implementation example of FIG. 3 having a raised footrest and the implementation example of Fig. 4 having the back ending in a canopy such as used on a roofed beach chair.

Figure 5:
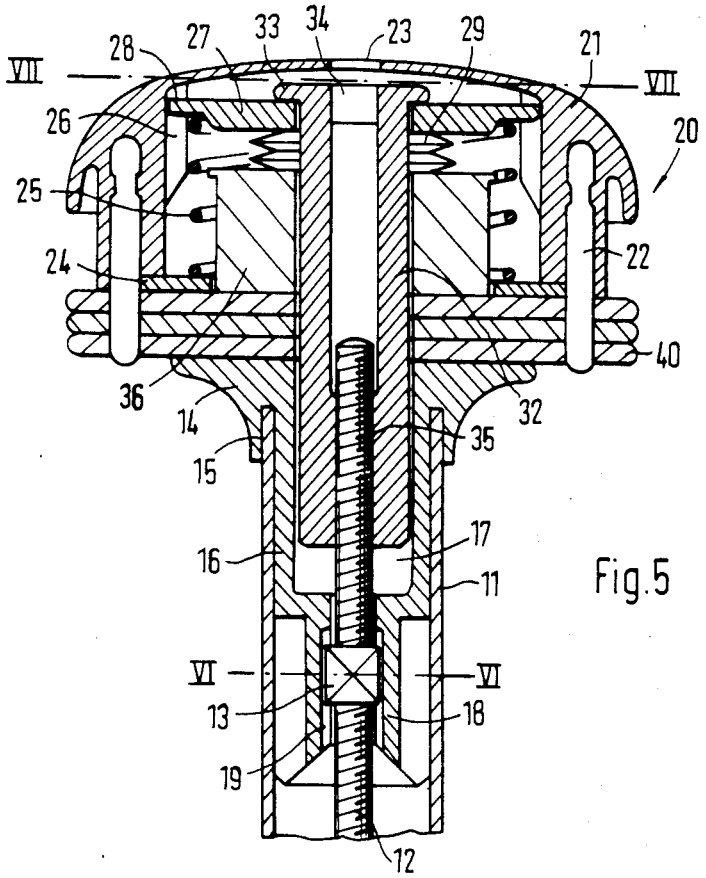
FIG. 5 is a cutaway view of the end of a bearing shaft showing the positioning element for locking the angular position of the connecting straps which meet here.
Figure 6:
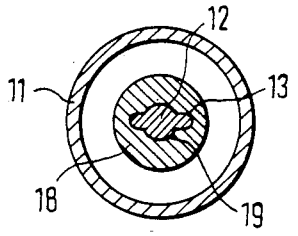
FIG. 6 is a partial cutaway view along line VI—VI of FIG. 5.

FIG. 5 depicts a cutaway view of the fittings on the end of one bearing shaft 11 of the upholstered furniture as shown in FIGS. 1 to 4. The bearing shaft 11 is designed as a section of pipe located in the center of the cylindrical padding element 10. The sleeve-shaped shoulder 16 of the disk-shaped retainer 14 is inserted into the open end of the section of pipe. The retainer 14 is provided with the annular slot into which the section of pipe is inserted on the side facing the end of the bearing shaft 11. The shoulder 16 of the retainer 14 accommodates the threaded rod 12 in the center, the rod being held so that it does not rotate in the end section 18 of the shoulder 16 by means of flat areas 13 as shown in the partial cutaway view of FIG. 6. The threaded rod 12 protrudes into the recess 17 of the shoulder 16 which accommodates the bearing bush 32. In turn, the bearing bush 32 is screwed onto the end of the threaded rod 12 by means of the internal screw thread 35. However, before this is done, the fitting is preassembled as a unit.

The pins 22 are embedded in the cap-shaped positioning element 21 allowing the flat areas in the positioning element 21 produced by injection molding to be seen. The base of the cap has an opening 23 providing access to the tool seat 34 on the facing end of the bearing bush 32. The bearing bush is pushed onto the base plate 26 up to the stop on the stop collar 33. Then, the compression spring 29 designed as a Belleville or disk spring is pushed onto the bearing bush 32. The hollow cylindrical supporting block 36 makes contact with this compression spring 29. The additional compression spring 25 is braced on the base plate 27 as the coil spring surrounding the compression spring 29 and the supporting block 36. Then, the compartment of the cap-shaped positioning element 21 is closed using the supporting plate 24 which serves as a retainer for the additional compression spring 25 and which also captures the supporting block 36 with the compression spring 29, the base plate 27 and the bearing bush 32 in the compartment of the positioning element 21. Because of this, these parts form a preassembled unit which can easily be connected using the threaded rod 12. The pins 22 are fed through the aligned holes 38 of the connecting ends 3I of the connecting straps 30 which meet in the area of the bearing shaft 11. An additional mounting piece 40, such as armrests or a foot, can be engaged by the pins 22 with a corresponding connecting end as shown in Fig. 5. A tool is inserted into the tool seat 34 of the bearing bush 32 by way of the opening 23 of the positioning element 21. The bearing bush 32 can be rotated using this tool and screwed using the threaded rod 12. The compression spring 29 braces the connecting ends 31 of the connecting straps 30 and any additional mounting pieces 40 against the retainer 14 by way of the supporting block 36.

If the locking of the connecting ends 31 of the connecting straps 30 is to be released, the positioning element 21 is pulled against the spring force of the additional compression spring 25 until the pins 22 are disengaged from the aligned holes 38 of the connecting ends 31 of the connecting straps 30 and the additional mounting pieces 40.

Figure 7:
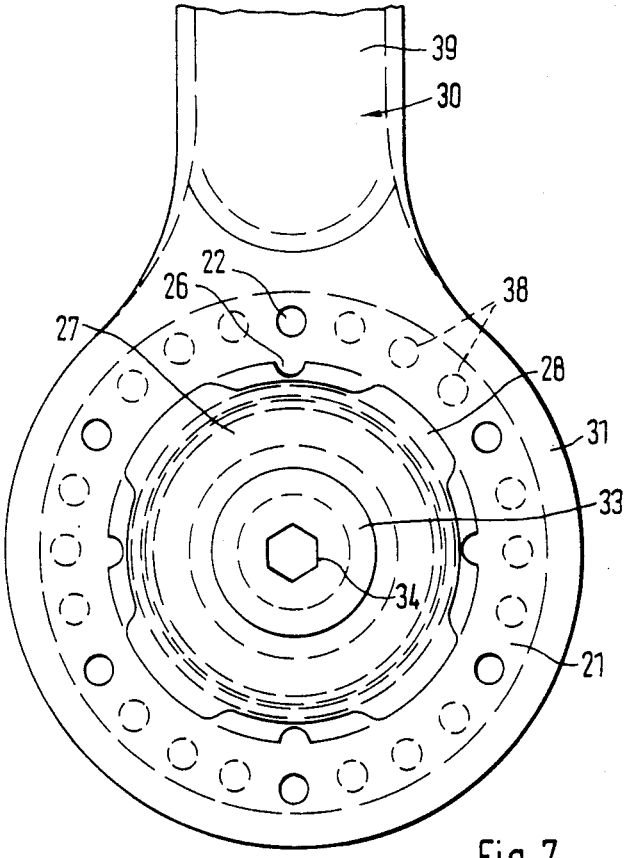
FIG. 7 shows a view along line VII—VII of FIG. 5.
Figure 8:
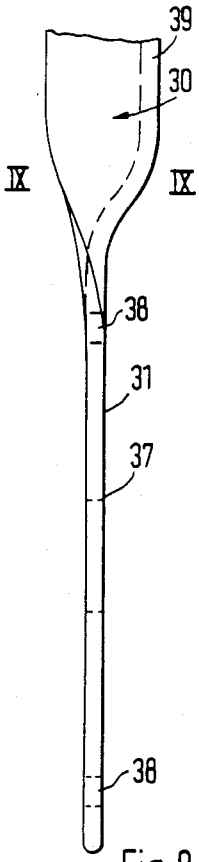
FIG. 8 is, a side view of the connecting end of a connecting strap.
Figure 9:
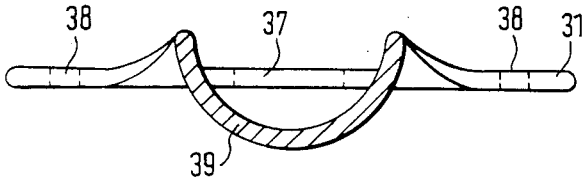
FIG. 9 shows a cutaway view through the connecting strap along line IX—IX of FIG. 8.

In so doing, the dogs 26 of the compartment are retracted from the areas between the plate-shaped shoulders 28 of the base plate 27 so that the positioning element 21 can be rotated. The positioning element 21 is rotated only through a few angle spaces between the holes 38 so that the dogs 26, using their beveled ends, can rest on the shoulders 28 of the base plate 27 under the spring force of the additional compression spring 25 after the positioning element 21 has been released. Due to this, the positioning element 21 with the pins 22 embedded in it remains in the unlatched position. The connecting straps 30 can be rotated as desired, even if the compression spring 29 presses the supporting block 36 against the connecting ends 31 of the connecting straps 30, the additional mounting piece 40 and the retainer 14. Once the new angular position of the connecting straps 30 has been set, the positioning element 21 is raised slightly and rotated back until the dogs 26 of the compartment of the positioning element 21 can again be inserted between the shoulders 28 of the base plate 27. The pins 22 of the positioning element 21 are inserted into new aligned holes 38 of the connecting ends 31 of the connecting straps 30 and of the mounting piece 40. This locks the new position of the connecting straps 30. The design of the dogs 26 with a semicircular cross-section and of the plate-shaped shoulders 28 of the base plate 27 can be seen clearly in FIG. 7. The six-sided tool seat 34 can also be seen in the front end of the bearing bush 32. The holes 38 in the connecting ends 31 of the connecting straps 30 are placed at a uniform angular spacing of 15° so that there are 24 holes in each end. The positioning element 21 has only 6 pins 22 which are embedded in the positioning element 21 at an angular spacing of $4\times15=60°$. The supporting hole 37 of the connecting ends 31 of the connecting straps 30 is centered with respect to the circle of holes 38 and designed for the outer diameter of the bearing bush 32. Outside the connecting ends 31, the connecting strap 30 is curved in a semicircle as shown in FIGS. 8 and 9 using the reference number 39. Because of this curvature, the connecting straps 30 are provided with sufficient rigidity. It should still be mentioned that, in the case of the connecting straps 30, the connecting ends 31 lie in the same plane or they can be offset respect to one another by the thickness of the connecting ends 31.

I claim:

1. Upholstered furniture of the type having a number of cylindrical padding elements, mounted on bearing shafts, with the ends of said bearing shafts on both sides of said padding elements being positioned immediately adjacent to one another and connected together by straps in a manner similar to an open bicycle chain with the ends of said connecting straps each being provided with a series of angularly spaced apart holes arranged in a circle pivoting on the bearing shafts, and being adjustable at set angles with respect to one another by means of a positioning element equipped with pins, said pins being able to engage in the holes of the ends of adjacent connecting straps when such holes are aligned, said ends being mounted on a bearing shaft, and, to adjust the angular position of the connecting straps, said pins being also retractable characterized in that the connecting ends (31) of the connecting straps (30) are each pivoted on a bearing bush (32) which is connected at one end to the bearing shaft (11) by means of a threaded connection (12, 35), the other end of the bearing bush (32) is equipped with a stop collar (33) and a tool seat (34), a base plate (27), fixed to the bearing bush (32) so that the plate rotates, is supported on the stop collar (33), a compression spring (29) which presses the connecting ends (32) of the corresponding connecting straps (30) against a retainer (14) at the end of the bearing shaft (11) by means of a hollow, cylindrical supporting block (36) is pressed over the bearing bush (32) following the base plate (27), a cap shaped positioning element (22) has a compartment which is open on one side and which contains the bearing shaft (32), the base plate (27), the compression spring (29) and the supporting block (36), the cap shaped element further has a base which is equipped with an opening (23) to provide access to the tool seat (34) of the bearing bush (32), an additional compression spring (25) is braced against the base plate (27), the other end of said compression spring being held in the area of the open side of the compartment by means of a supporting plate (24), and the base plate (27) is provided with shoulders (28) around the circumference, dogs (26) formed on the compartment protruding between said shoulders, said dogs extending, starting from the base of the cap, only a portion of the depth of the compartment in the positioning element (21).

2. Upholstered furniture as set forth in claim 1 characterized in that:

the holes (38) in the connecting ends (31) of the connecting straps (30) are uniformly spaced at specific angles of 15° and the pins (22) are located on the positioning element (21) spaced at angles which are an integer multiple of the angle of 15°.

3. Upholstered furniture as set forth in claim 1 or 2 characterized in that the connecting straps (30) are curved in a semicircle outside the connecting ends (31).

4. Upholstered furniture as set forth in claim 3 characterized in that the bearing shaft (11) is designed as a section pipe having open ends, one disk-shaped retainer (14) is inserted in each open end of the section of pipe, said retainer being held with a sleeve-shaped shoulder (16), said shoulder (16) is provided with a recess (17) for the bearing bush (32), and a threaded rod (12) is held in the shoulder (16) so that the rod cannot rotate and so that it is centered with respect to the section of pipe, said bearing bush (32) with an internal screw thread (35) being screwed onto said rod.

5. Upholstered furniture as set forth in claim 4 characterized in that the retainer (14) is provided with an annular slot (15) on the side facing the end of the section of pipe, the end of the section of pipe being inserted into said annular slot.

6. Upholstered furniture as set forth in claim 5 characterized in that the compression spring (29) pushed onto the bearing bush (32) following the base plate (27) is designed as a Belleville spring.

7. Upholstered furniture as set forth in claim 6 characterized in that the ends of the dogs (26) facing the connecting ends (31) of the connecting straps (30) are beveled as they progress into the compartment of the positioning element (21).

8. Upholstered furniture as set forth in claim 7 characterized in that the ends of the dogs (26) have a semicircular cross-section of the holes (38) in the connecting ends (31) of the connecting straps (30) and of the pins (22) embedded in the positioning element (21), and the shoulders (28) on the base plate (27) are designed in the shape of plates and extend over a number of the angle spaces between the holes (38) in the connecting ends (31) of the connecting straps(30).

9. Upholstered furniture as set forth in claim 8 characterized in that the pins (22) which are provided with flat surfaces are injected into a positioning element (21) designed as an injection-molded piece.

10. Upholstered furniture as set forth in claim 9 characterized in that the additional compression spring (25) is designed as a coil spring, the compression spring (29) is designed as a Belleville spring, and the additional compression spring (25) surrounds the compression spring (29) and the supporting block (36) and the supporting plate (24), after the bearing bush (32), the base late (27), the two compression springs (25, 29) and the supporting block (36) are inserted into the compartment of the positioning element (21) captures them in the compartment of the positioning element (21).

* * * * *